US007089768B2

(12) United States Patent
Bolduan et al.

(10) Patent No.: US 7,089,768 B2
(45) Date of Patent: Aug. 15, 2006

(54) WASHING MACHINE WITH CONVEYOR DEVICE

(75) Inventors: Edwin Bolduan, Berlin (DE); Wolfgang Proppe, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/608,631

(22) Filed: Jun. 27, 2003

(65) Prior Publication Data

US 2004/0000175 A1 Jan. 1, 2004

Related U.S. Application Data

(63) Continuation of application No. PCT/EP01/14908, filed on Dec. 17, 2001.

(30) Foreign Application Priority Data

Dec. 27, 2000 (DE) ..... 100 65 335

(51) Int. Cl.
*D06B 1/02* (2006.01)

(52) U.S. Cl. ..... 68/5 C; 68/13 R; 68/19; 68/22 R

(58) Field of Classification Search ..... 68/3 R, 68/5 B, 5 C, 13 R, 19, 22 R, 184; 134/64 R, 134/70, 71, 72, 73, 74, 122 R, 142, 158
See application file for complete search history.

(56) References Cited

U.S. PATENT DOCUMENTS 1,864,738 A * 6/1932 King ..... 68/58
1,926,977 A * 9/1933 Ermisch ..... 68/148
1,997,267 A * 4/1935 Remington ..... 38/2
2,064,512 A * 12/1936 Wilson et al. ..... 68/9
2,273,939 A * 2/1942 Dammers ..... 134/74
2,358,507 A * 9/1944 Haberstump ..... 134/72
2,366,136 A * 12/1944 Waldstein ..... 68/9
2,386,781 A * 10/1945 Daly ..... 134/71
2,530,494 A * 11/1950 Vigerust ..... 68/9
2,539,112 A * 1/1951 Bash ..... 202/170
2,556,143 A * 6/1951 McLeod ..... 409/33
2,632,961 A * 3/1953 Robertson ..... 34/661
2,673,835 A * 3/1954 Kearney ..... 134/79
2,732,701 A * 1/1956 Smith et al. ..... 68/20
2,808,064 A * 10/1957 Kearney ..... 134/58 R
2,845,786 A * 8/1958 Chrisman ..... 68/18 R
2,902,138 A * 9/1959 Heinrich ..... 198/340
2,943,424 A * 7/1960 Sadwith ..... 134/72
3,002,731 A * 10/1961 Gelfand et al. ..... 366/118
3,009,343 A * 11/1961 Bochan ..... 68/20
3,113,004 A * 12/1963 Shaw ..... 34/95
3,192,935 A * 7/1965 Hanifan ..... 134/142
3,257,739 A * 6/1966 Wentz ..... 34/493
3,292,397 A * 12/1966 Wooliever ..... 68/19.1

(Continued)

FOREIGN PATENT DOCUMENTS

DE 1 610 105 11/1970

(Continued)

*Primary Examiner*—Frankie L. Stinson
(74) *Attorney, Agent, or Firm*—John T. Winburn; Russell W. Warnock; Craig J. Loest

(57) ABSTRACT

A cabinet-shaped washing machine includes a conveyor belt to move laundry goods in circulation, with the laundry goods passing through various successive steps of the laundry cycle. Following the actual washing process, a downstream pre-dehumidification as well as a drying and pressing phase can be realized in the same housing.

14 Claims, 2 Drawing Sheets

U.S. PATENT DOCUMENTS

| | | | | | |
|---|---|---|---|---|---|
| 3,312,230 | A | * | 4/1967 | Wooldridge | 134/72 |
| 3,321,843 | A | * | 5/1967 | Taran | 34/596 |
| 3,350,224 | A | * | 10/1967 | Sadwith | 134/33 |
| 3,352,723 | A | * | 11/1967 | Smull | 148/253 |
| 3,362,723 | A | * | 1/1968 | Bretholz | 280/221 |
| 3,499,176 | A | * | 3/1970 | Bahnsen | 8/149.1 |
| 3,548,509 | A | * | 12/1970 | Chaknova | 34/328 |
| 3,650,672 | A | * | 3/1972 | Swayn | 8/137 |
| 3,763,672 | A | * | 10/1973 | Bahnsen | 68/205 R |
| 3,768,283 | A | * | 10/1973 | Bold et al. | 68/205 R |
| 3,780,543 | A | * | 12/1973 | Rosenfeld et al. | 68/18 F |
| 3,796,186 | A | * | 3/1974 | Bounds et al. | 118/603 |
| 3,827,262 | A | * | 8/1974 | Manuel | 68/3 R |
| 3,868,835 | A | * | 3/1975 | Todd-Reeve | 68/20 |
| 3,884,632 | A | * | 5/1975 | Payet et al. | 8/116.4 |
| 3,927,539 | A | * | 12/1975 | Harkison | 68/3 R |
| 3,942,340 | A | * | 3/1976 | Kirkby | 68/3 R |
| 4,219,948 | A | * | 9/1980 | Miranker | 38/10 |
| 4,231,239 | A | * | 11/1980 | Lazaroff | 68/205 R |
| 4,300,366 | A | * | 11/1981 | Barrett | 68/3 R |
| 4,361,018 | A | | 11/1982 | Gallagher | |
| 4,391,602 | A | * | 7/1983 | Stichnoth et al. | 8/149.1 |
| 4,412,435 | A | | 11/1983 | Gallagher | |
| 4,425,842 | A | | 1/1984 | Winch et al. | |
| 4,434,633 | A | | 3/1984 | Winch et al. | |
| 4,454,668 | A | * | 6/1984 | Krauss et al. | 38/11 |
| 4,891,894 | A | * | 1/1990 | Veit | 38/66 |
| 5,046,209 | A | * | 9/1991 | Keilhack | 8/152 |
| 5,502,988 | A | * | 4/1996 | Shimazaki et al. | 68/3 R |
| 6,516,536 | B1 | * | 2/2003 | Ryden | 34/106 |

FOREIGN PATENT DOCUMENTS

| | | | |
|---|---|---|---|
| DE | 1 928 923 | | 12/1970 |
| DE | 2 014 161 | | 5/1971 |
| DE | 2644424 | * | 4/1977 |
| DE | 2828423 | * | 1/1980 |
| DE | 32 16 195 A1 | | 11/1982 |
| DE | 4201284 | * | 7/1993 |
| GB | 13 16 613 | | 5/1973 |
| JP | 3-297497 | * | 12/1991 |
| JP | 5-337300 | | 12/1993 |
| JP | 6-126098 | * | 5/1994 |
| JP | 10-118398 | | 5/1998 |
| JP | 10-151292 | * | 6/1998 |
| NL | 1005069 | | 7/1998 |

* cited by examiner

WASHING MACHINE WITH CONVEYOR DEVICE

CROSS-REFERENCE TO RELATED APPLICATION

This application is a continuation of copending International Application No. PCT/EP01/14908, filed Dec. 17, 2001, which designated the United States and was not published in English.

BACKGROUND OF THE INVENTION

Field of the Invention

The invention relates to a washing machine having a housing, a laundry goods mover, and suds application device, and a device to remove dissolved dirt from the laundry goods.

Washing machines of the aforementioned type are known from the state of the art as household washing machines that are sold commercially. To agitate the laundry goods, such household washing machines have a washing drum into which the suds are flushed. The dirt dissolved in the laundry goods is, then, removed in a rinsing cycle.

Furthermore, washing and laundry facilities for industrial laundry purposes are known from the state of the art.

U.S. Pat. No. 5,502,988 to Shimazaki et al. discloses an industrial laundry device having a conveyor chain to transport the laundry goods through the various laundry processing steps. Furthermore, U.S. Pat. No. 4,412,435 to Gallagher discloses a continuous operation laundry system having a device for mechanically manipulating the laundry goods. A corresponding system is also disclosed in U.S. Pat. No. 4,361,018 to Gallagher.

Netherlands Patent Document 1005069 C2 discloses an industrial hot mangle for drying and pressing laundry goods having a continuous conveyor belt. The conveyor belt is partially guided along a steam system.

Japanese Patent Document JP-A-10118398 is a drying-, smoothing- and pressing system for laundered goods having a band to take up the humidity as well as rollers for the transport of the laundered goods.

Japanese Patent Document JP-A-5337300 discloses an industrial laundry device with a conveyor that transports the laundry goods through the various laundry processing steps in the system.

U.S. Pat. No. 5,349,768 discloses a conveyor for moving the laundry goods where the laundry goods to be transported are coupled to the conveyor belt by fastening clips.

German Published, Non-Prosecuted Patent Application 3216195 A, corresponding to U.S. Pat. No. 4,434,633 to Winch et al. and to U.S. Pat. No. 4,425,842 to Winch et al., discloses a squeezing device where the laundry goods are pressed against a roll by a conveyor belt to perform a pre-dehumidification.

SUMMARY OF THE INVENTION

It is accordingly an object of the invention to provide a washing machine with conveyor device that overcomes the hereinafore-mentioned disadvantages of the heretofore-known devices of this general type and that improves the prior art washing machines.

With the foregoing and other objects in view, there is provided, in accordance with the invention, a washing machine, including a housing, a conveyor disposed in the housing for moving laundry goods in a circulation in the housing, a suds application device at least partially disposed in the housing for applying suds to the laundry goods, and a cleaning device at least partially disposed in the housing for removing dissolved dirt from the laundry goods.

With the objects of the invention in view, there is also provided a washing machine, including a housing, means for transporting laundry goods in a circulation in the housing, means for applying suds to the laundry goods, and means for removing dissolved dirt from the laundry goods.

Preferably, the conveyor is a conveyor belt or a conveyor chain.

With the invention, the laundry goods to be washed can be hung onto the conveyor belt located in the washing machine, for example, on a hanger or a rod. The washing cycle is, then, performed on the hanging laundry goods. After the washing cycle is completed, the laundry goods are, then, in their ready-to-use position, i.e., they can be either removed manually or automatically from the washing machine to be hung onto a clothing rod.

A special advantage of the invention is that the conveyor device of the washing machine can put the laundry goods into circulation within the housing of the washing machine. Various devices for realizing the individual steps of the laundering process can be disposed along the circulation. This makes it possible—depending on the degree of soiling—to repeat the individual steps of the washing process several times.

For example, it is possible to dispose nozzles along a segment of the circulation to moisten the laundry goods to ensure a better uptake of the laundry detergent and/or the suds.

In accordance with another feature of the invention, the housing is cabinet-shaped and has a wall, preferably, a side wall, and the conveyor circulates the laundry goods substantially parallel to the wall.

In accordance with a further feature of the invention, the conveyor has a circulation extent and catches distributed along the circulation extent for taking up laundry goods and the catches are shaped to receive at least one of a hook, a laundry hanger, a clothes hanger, a hook of a laundry hanger, a hook of a clothes hanger, a clamping device of a laundry hanger, a clamping device of a clothes hanger, and a mesh laundry bag.

In accordance with an added feature of the invention, the conveyor has conveying states dependent upon a laundry cycle to be performed, the conveying states including keeping the laundry goods stationary, circulating the laundry goods at a constant speed, and moving the laundry goods back and forth.

In another segment of the circulation, nozzles may be disposed to spray the laundry goods with suds for soaking. The dirt is, then, dissolved by the action of the detergent on the laundry goods.

Then, the dissolved dirt is removed from the laundry goods in a rinsing cycle. The rinsing cycle can be realized by rinsing nozzles disposed in another segment of the circulation to spray rinse water on the laundry goods.

In accordance with an additional feature of the invention, there is provided a pre-dehumidification device disposed in a given area of the circulation for at least partially removing liquid from the laundry goods.

After the laundered goods are clean, it is advantageous to perform a step for the preliminary dehumidification of the laundry goods.

In accordance with yet another feature of the invention, a pair of rollers disposed in the housing along the circulation effects the preliminary dehumidification of the laundry goods. The laundry goods are pulled through the pair of rollers by the conveyor device to at least partially extract the rinsing water in the laundry goods.

In accordance with yet a further feature of the invention, the the pre-dehumidification is performed by pressing the laundry goods against an absorbable fleece. Preferably, the laundry goods are pressed against the fleece in an area of the circulation by a roller and pulled along simultaneously by the conveyor system.

At least in one area of the pressure point of the roller, the fleece takes up water from the laundered goods, thus, pre-dehumidifying the laundered goods. The fleece is, at least during pressing, substantially guided parallel to a motion of the respective laundry goods.

In accordance with yet an added feature of the invention, the pre-dehumidification of the laundered goods is performed by hot or cold compressed air. The pre-dehumidification can be performed according to the outgoing air principle as well as according to the condensation dryer principle.

In accordance with yet an additional feature of the invention, the pre-dehumidification device has an air supplying device to apply compressed air to the laundry goods.

In accordance with again another feature of the invention, the pre-dehumidification device has a mesh for receiving thereat the laundry goods while the air supplying device is applying the compressed air.

The invention, furthermore, allows the integration of a drying and a smoothing and/or pressing function in the housing of the washing machine by disposing appropriate aggregates along the circulation of the laundry goods in the housing.

To realize the smoothing and/or pressing function, it is possible, for example, to guide compressed air into the laundry goods by suspending the laundry goods at the conveyor belt, thus, "inflating" the laundry goods from the inside. To generate a counter pressure, the laundry goods can be simultaneously brushed with compressed air from the outside.

In accordance with a concomitant feature of the invention, there are provided members disposed at the conveyor for holding the laundry goods, the members being fluidically connected to the integrated drying device for introducing hot air into the laundry goods through the members.

Other features that are considered as characteristic for the invention are set forth in the appended claims.

Although the invention is illustrated and described herein as embodied in a washing machine with conveyor device, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
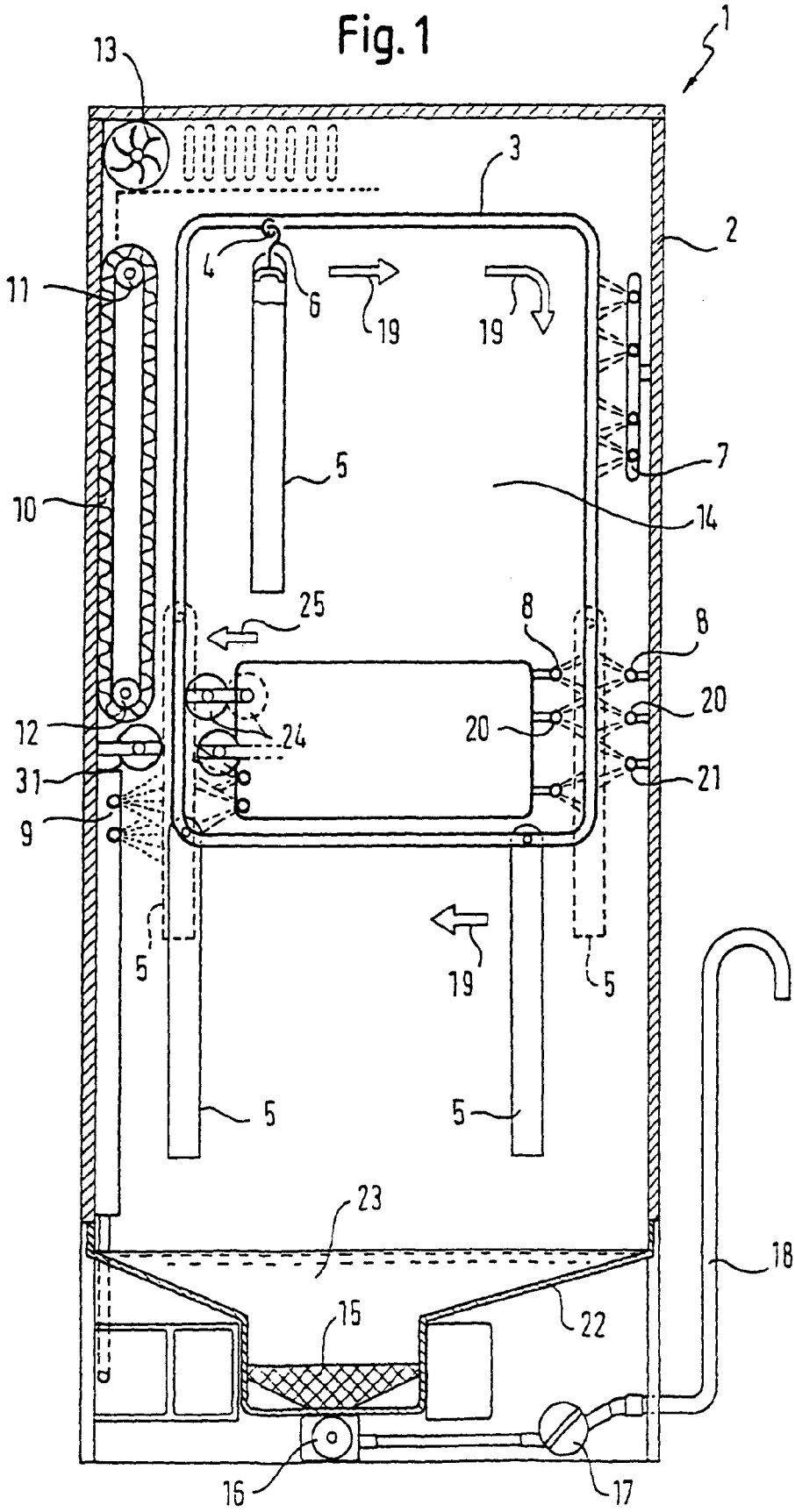
FIG. 1 is a cross-sectional view through a washing machine according to the invention parallel to a plane of a conveyor belt.

Referring now to the figures of the drawings in detail and first, particularly to FIG. 1 thereof, there is shown a washing machine 1 having a cabinet-shaped housing 2. The height of the housing 2 may be, for example, up to 2 meters. The other dimensions of the washing machine 1, preferably, correspond to those of conventional household appliances.

In the housing 2, a conveyor device, preferably, a continuous conveyor belt 3 is driven, redirected, and controlled by a non-illustrated motor of the washing machine 1 by non-illustrated rollers or gear wheels. Alternately, the conveyor device 3 may also be realized as a conveyor chain, for example.

The conveyor belt 3 has catches that are developed as ears 4. Each of the ears 4 can take up a hook or a clip to fasten laundry goods to the conveyor belt 3. For example, the laundry goods 5 can be on a clothes hanger 6. The clothes hanger 6, then, engages with its hook at the ear 4. As such, the laundry goods 5 can be hung into the conveyor belt 3 similar to being hung on hangers in a clothes closet. The fact that the housing has the shape of a cabinet and the circulation is guided substantially parallel to a wall of the housing, preferably, to the sidewall of the housing, enormously simplifies the hanging and removing of the laundry goods.

Spray nozzles 7 for spraying the laundered goods 5 with water are located at the interior side of the housing 2. Furthermore, cleaning nozzles 8 are disposed along the conveyor belt 3 at the interior side of the housing 2 to spray suds on the laundry goods. Rinsing nozzles 20,21 are located below the cleaning nozzles 8 to spray the laundry goods 5 with rinsing water and rinse out the dissolved dirt from the laundry goods 5.

A hot air compressor, blower or fan 9 is located at the opposite interior side of the housing 2 in an area of the conveyor belt 3 to brush the laundry goods 5 with warm or hot air. An absorbable fleece 10, which is guided over rollers 11 and 12, is located above the hot air compressor 9. At least one of the rollers 11 or 12 can be driven to move the fleece substantially synchronous to a circulatory movement of the conveyor belt 3 in the area of the fleece that directly faces and runs parallel to the conveyor belt 3.

Furthermore, there is a blower 13 in the housing 2. The blower 13 may suction air or blow off exhaust air. A heat exchanger 14, which is located in the back wall of the housing 2, is advantageously developed as a rinsing container. The rinsing container, thus, on one hand, has the function of storing the water for the rinsing cycles, while, at the same time, serving as a condenser for the condensation of the water taken up from the laundered goods 5 by the compressed air. The water in the rinsing container is preheated by the heat exchange with the condensing steam. This reduces the energy consumption of the washing machine 1.

In the lower area of the housing 2, a lint screen 15 is in a suds collection container 22 that catches the water. Under the suds collection container 22 is a circulating pump 16 for wetting and/or spraying the laundry goods 5 through the spray nozzles 7 and/or the cleaning nozzles 8, as well as an outflow pump 17 for re-circulating or pumping off suds through the hose 18.

In a front area of the housing 2, below and/or above a door opening in the housing 2, can be placed a heater in the form of heating coils. These heating coils are not illustrated in FIG. 1.

In preparation for the washing process, the laundry goods 5 are, first, hung into the conveyor belt 3. If the laundry goods 5 are men's shirts or ladies' blouses, for example, it is advantageous to hang them on one respective clothes hanger into an eye 4 of the conveyor belt 3.

For other laundry goods, which cannot be hung easily onto a clothes hanger—such as underwear and socks, for example—the use of a mesh laundry bag is advantageous. One or more pieces of such laundry goods are placed into a mesh laundry bag having, at an upper end, a hook corresponding to the hook of the clothes hanger 6 shown in FIG. 1. Like a clothes hanger 6, the mesh laundry bag can, then, be hung with its hook into an eye 4 in the conveyor belt 3.

The laundry detergent is added to the suds collection container 22. This can occur through a storage- and dosage container combination according to the principle of a flush-in tray.

After starting the washing cycle, the detergent will dissolve in the water bath and will be supplied to the cleaning nozzles 8 at the appropriate time through the circulation pump 16.

To perform a washing cycle, the conveyor belt 3 is brought into a circulating motion in a first step according to the direction of movement shown by the arrows 19. The circulation speed of the conveyor belt 3 and, thus, the laundry goods 5 transported by the conveyor belt 3 corresponds to the respective required washing cycle speed.

The spray nozzles 7 wet the passing laundry goods 5 to moisten the goods 5 and to accelerate the take-up of detergent in the laundry goods 5.

In a second step, the laundry goods pass the cleaning nozzles 8, which spray suds on the laundry goods 5. The suds soak the laundry goods 5 and, thus, dissolve the dirt.

In a third step, fresh water is sprayed from the rinse nozzles 20 to the passing laundry goods 5 to remove the dirt and the suds.

By non-illustrated sensors attached to the housing 2, the cleaning efficiency of the laundry goods 5 can be checked and/or the clouding of the suds can be measured and evaluated, if applicable. If the degree of cleanliness is not sufficient, the aforementioned steps can be repeated as often as necessary.

The suds and/or the rinse water drips from the wet laundry goods 5 into the suds collection container 22 and is circulated from there to the cleaning nozzles 8 and/or pumped off by the outflow pump 17. In principle, it is not required with the washing machine 1 to introduce the laundry goods 5 into the suds 23 in the suds collection container 22; rather, the suds are applied to the laundry goods 5 merely through the cleaning nozzles 8 in the shown example.

To improve the water exchange, the laundry goods 5 can be placed against a guide. Furthermore, the process of water exchange and/or the water release can be intensified and accelerated with the help of a pair of rollers.

The completion of the wet phase, where the laundry goods are washed, is followed by the dry phase. After turning off the fresh water supply to the rinsing nozzles 20, dry, heated compressed air is supplied to the laundry goods over a compressor or the blower 13 for the drying process. The drying time and the related intensive air exchange with the air in the housing 2 can be shortened by an additional circulation or back and forth movement of the laundry goods 5 by the conveyor belt 3.

Prior to the actual drying of the laundry goods 5, it is advantageous to perform a pre-dehumidification of the laundry goods 5.

For such a purpose, in a first embodiment shown in FIG. 1, a pair of rollers 31, controlled electronically by non-illustrated spaced sensors, drives on both sides against the laundry goods 5 moved by the conveyor belt 3 so that the laundry goods 5 are pulled through the pair of rollers 31. The pressure exerted on the laundry goods 5 located between the rollers 31 of the roller pair presses the water from the laundry goods 5 and the water drips back into the suds collection container 22. Instead of a pair of rollers 31, it is also possible to provide a roller chain so that, rather than being pulled through the pair of rollers, the laundry goods 5 are pulled through a roller chain disposed on both sides of the laundry goods 5.

In the preferred embodiment shown in FIG. 1, the laundry goods are pulled against the fleece 10 by a roller 24 as soon as they have reached the area of the fleece 10. For such a purpose, the roller 24 moves into the direction of the arrow 25 to press the laundry goods 5 against the fleece. At the point where the roller 24 meets the laundry goods 5, a pressure is exerted to press the laundry goods 5 against the fleece 10 so that the water in the laundry goods 5 is, at this point, at least partially absorbed by the fleece 10. At the same time, the conveyor belt moves the respective laundry goods 5 along the direction of movement of the arrow 19 so that the area where the roller 24 meets the laundry goods 5 changes as well.

Parallel to the movement of the conveyor belt 3 and the respective laundry goods 5, the fleece 10, which is guided on the rollers 11 and 12, also continues to move forward. This has the advantage that an area of the fleece 10, which is still dry and, thus, absorbable, is available at the point where the goods 5 are pressed against the fleece 10 by the roller 24. For example, the water absorbed in the fleece can be pressed out by another pair of non-illustrated rollers on the side directly facing the housing 2 during the reverse motion of the water-soaked fleece.

According to another preferred embodiment, the pre-humidification can occur by dry compressed air that is placed directly on the laundry goods. The dry air is evenly distributed by the hot air compressor and applied to the laundry goods. In addition, the laundry goods can be set between non-illustrated meshes during the application of the compressed air. Advantageously, the compressed air is added in a controlled process in partial steps.

The aforementioned steps can be performed in combination or successively—even repeatedly—to obtain an optimum cleaning effect.

Figure 2:
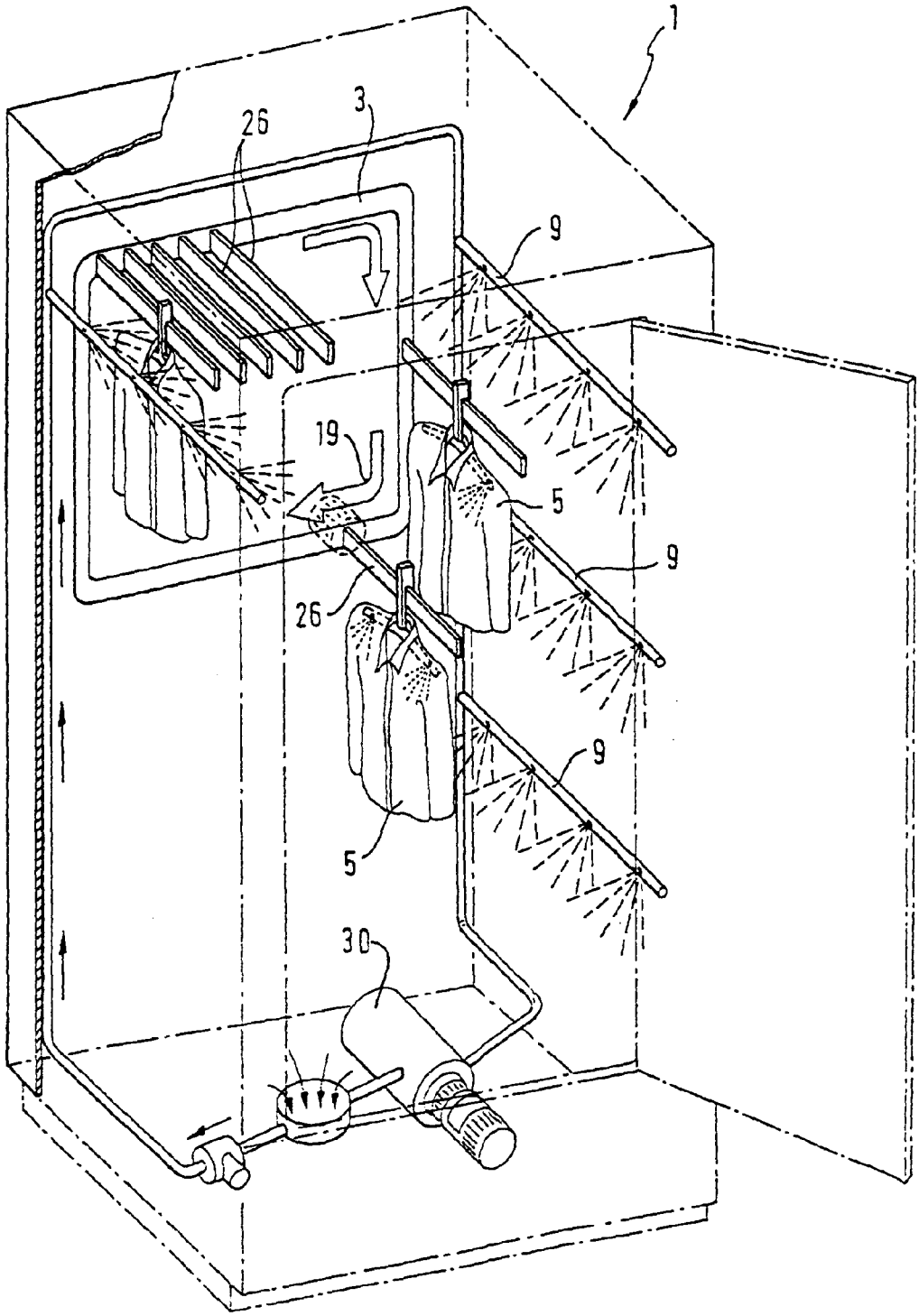
FIG. 2 is a perspective view from above a washing machine according to the invention with a pressing function.

FIG. 2 shows another preferred embodiment of the washing machine in accordance with the invention. The same reference symbols are used for the corresponding elements in the embodiment in FIG. 1 and the embodiment in FIG. 2.

FIG. 2 shows a washing machine 2 with a smoothing- and pressing function. In the shown embodiment, the washing- and drying phases are followed by a smoothing and/or pressing phase.

The conveyor belt 3 is developed in two parts. Only the rear part of the conveyor belt 3 is shown in FIG. 2. Located between the two parts of the conveyor belt 3 are the members 26, and the laundry goods 5 can be hung onto the members 26. The members 26 are developed with a hollow interior to convey compressed air. Hot air can be blown into the laundry goods 5 that are hanging on the members 26 through a compressor 30 and, then, through the members 26.

Hot air compressors 9 are disposed along an interior side of the housing 2. To realize the smoothing- and/or pressing function, hot air is blown into the laundry goods 5 through the members 26 so that the laundry goods 5 are loaded with the pressure of hot air from the inside. At the same time, the laundry goods 5 are moved past the hot air compressors 9 by the movement of the conveyor belt 3 in the direction of the arrow 19 so that the laundry goods 5 are loaded with compressed air from the outside as well and a counter-pressure is created. This leads to the desired smoothing and pressing effect.

After completion of the smoothing and pressing process, the laundry goods 5 are in the ready-to-use position. They can be removed automatically from the washing machine 1 and sorted into a clothes- or laundry cabinet.

We claim:

1. A washing machine, comprising:

a housing;

a conveyor disposed in said housing for moving laundry goods in a circulation along a closed looped path in said housing;

a suds application device at least partially disposed in said housing for applying suds to the laundry goods; and a cleaning device at least partially disposed in said housing for removing dissolved dirt from the laundry goods;

an integrated smoothing and pressing device for smoothing and pressing the laundry goods;

said conveyor has a circulation extent and catches distributed along said circulation extent for taking up laundry goods; and said catches are shaped to receive at least one of a hook, a laundry hanger, a clothes hanger, a hook of a laundry hanger, a hook of a clothes hanger, a clamping device of a laundry hanger, a clamping device of a clothes hanger, and a mesh laundry bag.

2. The washing machine according to claim 1, wherein:

said housing is cabinet-shaped and has a wall; and said conveyor circulates the laundry goods substantially parallel to said wall.

3. The washing machine according to claim 2, wherein said wall is a side wall of said housing.

4. The washing machine according to claim 1, wherein said conveyor is a conveyor belt or a conveyor chain.

5. The washing machine according to claim 1, wherein said conveyor has conveying states dependent upon a laundry cycle to be performed, said conveying states including keeping the laundry goods stationary, circulating the laundry goods at a constant speed, and moving the laundry goods back and forth.

6. The washing machine according to claim 1, wherein said suds application device is disposed in a given area of said circulation.

7. The washing machine according to claim 6, wherein said suds application device has at least one nozzle for spraying suds onto the laundry goods.

8. The washing machine according to claim 1, wherein said cleaning device is disposed in a given area of said circulation.

9. The washing machine according to claim 1, wherein said cleaning device has a rinse water supply device for supplying rinse water to the laundry goods.

10. The washing machine according to claim 1, further comprising a pre-dehumidification device disposed in a given area of said circulation for at least partially removing liquid from the laundry goods.

11. The washing machine according to claim 10, wherein said pre-dehumidification device has an air supplying device to apply compressed air to the laundry goods.

12. A washing machine, comprising:

a housing;

a conveyor disposed in said housing for moving laundry goods in a circulation along a closed looped path in said housing;

said conveyor has a circulation extent and catches distributed along said circulation extent for taking up laundry goods;

said catches are shaped to receive at least one of a hook, a laundry hanger, a clothes hanger, a hook of a laundry hanger, a hook of a clothes hanger, a clamping device of a laundry hanger, a clamping device of a clothes hanger, and a mesh laundry bag;

a suds application device at least partially disposed in said housing for applying suds to the laundry goods; and a cleaning device at least partially disposed in said housing for removing dissolved dirt from the laundry goods; and a pre-dehumidification device disposed in a given area of said circulation for at least partially removing liquid from the laundry goods, said pre-dehumidification device having a pair of rollers through which the laundry goods are pulled.

13. A washing machine, comprising:

a housing;

a conveyor disposed in said housing for moving laundry goods in a circulation in said housing;

said conveyor has a circulation extent and catches distributed along said circulation extent for taking up laundry goods;

said catches are shaped to receive at least one of a hook, a laundry hanger, a clothes hanger, a hook of a laundry hanger, a hook of a clothes hanger, a clamping device of a laundry hanger, a clamping device of a clothes hanger, and a mesh laundry bag;

a suds application device at least partially disposed in said housing for applying suds to the laundry goods; and a cleaning device at least partially disposed in said housing for removing dissolved dirt from the laundry goods; and a pre-dehumidification device disposed in a given area of said circulation for at least partially removing liquid from the laundry goods;

said pre-dehumidification device having:

an absorbable fleece; and at least one roller for pressing the laundry goods against said fleece; and said fleece being, at least during pressing, substantially guided parallel to a motion of the respective laundry goods.

14. A washing machine, comprising:

a housing;

a conveyor disposed in said housing for moving laundry goods in a circulation along a closed looped path in said housing;

a suds application device at least partially disposed in said housing for applying suds to the laundry goods; and a cleaning device at least partially disposed in said housing for removing dissolved dirt from the laundry goods;

an integrated smoothing and pressing device for smoothing and pressing the laundry goods;

an integrated drying device for drying the laundry goods;

members disposed at said conveyor for holding the laundry goods, said members being fluidically connected to said integrated drying device for introducing hot air into the laundry goods through said members.

* * * * *